US006138292A

United States Patent [19]

O'Toole

[11] Patent Number: 6,138,292

[45] Date of Patent: Oct. 31, 2000

[54] COVER FOR TOILET HANDLE

[76] Inventor: Sean M. O'Toole, 1450 Brickell Bay Dr. #1002, Miami, Fla. 33131

[21] Appl. No.: 09/435,900

[22] Filed: Nov. 8, 1999

[51] Int. Cl.[7] ..... E03D 5/00

[52] U.S. Cl. ..... 4/405; 4/246.1

[58] Field of Search ..... 4/246.1, 249, 250, 4/405

[56] References Cited

U.S. PATENT DOCUMENTS

| | | | |
|---|---|---|---|
| D. 301,919 | 6/1989 | Paul . | |
| D. 318,715 | 7/1991 | Hardman . | |
| D. 318,716 | 7/1991 | Hardman . | |
| D. 319,297 | 8/1991 | Hardman . | |
| D. 319,865 | 9/1991 | Hardman . | |
| D. 320,646 | 10/1991 | Hardman . | |
| D. 356,145 | 3/1995 | Bollenbacher . | |
| D. 356,630 | 3/1995 | Chaung . | |
| D. 364,217 | 11/1995 | Dubin . | |
| D. 367,519 | 2/1996 | Bengtson . | |
| 4,353,139 | 10/1982 | Wainwright . | |
| 4,876,766 | 10/1989 | Cohen . | |
| 5,068,925 | 12/1991 | Salibi | 4/249 |
| 5,375,267 | 12/1994 | Davis | 4/246.1 |
| 5,435,016 | 7/1995 | Smith et al. . | |
| 5,727,258 | 3/1998 | Derouin | 4/246.1 |

*Primary Examiner*—Charles E. Phillips
*Attorney, Agent, or Firm*—Richard C. Litman

[57] ABSTRACT

A novelty cover used for commercial advertising, for the flush handle of commercially made toilets and urinals. One is a container, where printed matter which illustrates a particular advertisement is inserted between two tubes that make up a unitary piece. A second is a molded replica of a novelty piece or the actual product being advertised. Each embodiment is attached in the same manner by a Nylon, plastic, or rubber sleeve that slides onto the metal flush handle of a toilet and tightly fit onto the smallest diameter of the toilet flush handle by at least two Allen screws.

6 Claims, 2 Drawing Sheets

COVER FOR TOILET HANDLE

BACKGROUND OF THE INVENTION

1. Field of the Invention

The present invention relates to a novelty cover for the flush handle of a toilet, and more specifically, a novelty cover for advertising a business's product or any promotional material.

2. Description of the Related Art

Advertising one's product has been a traditional business practice for many centuries. Billboards, magazines, television, radio, and the Internet are the most popular forms of commercial advertising in today's marketplace. Customarily, businesses try to tailor their advertisements to be displayed or viewed in areas that are highly visible or areas that are often frequented by consumers. Businesses are always looking to be the first to advertise their product in new places.

Almost every public or commercial building has public restrooms where a majority of the visiting consumers usually make at least one trip to these facilities. Therefore, advertisements placed in the stalls of bathrooms have been an area of interest to many businesses. Naturally, everyone flushes the toilet using the flush handle. As a result, the toilet flush handle makes an ideal environment for developing business advertisement.

The following patents describe various apparatuses which mount onto either a water faucet or a toilet flush handle. U.S. Pat. No. 4,353,139, issued to Richard M. Wainwright on Oct. 12, 1982, describes a protective cover for individual water fixtures in the shape of animals to appeal to children. The bottom of the cylindrical side wall of this patent is longitudinally split to permit expansion over a spout. U.S. Pat. No. 4,876,766, issued to Richard K. Cohen on Oct. 31, 1989, describes a decorative faucet handle mounting apparatus having a bore shaped to the dimensions of a faucet stem.

U.S. Pat. No. 5,435,016, issued to Smith, et al. on Jul. 25, 1995, describes a toilet flush handle cover. This patent covers the flush handle of a toilet when the seat is raised to an upright position. The result is that the seat must be lowered before the handle may be used to flush the toilet. The handle cover is made of a thin sheet of metal or plastic bent or formed to cover a flush handle.

The following design patents illustrates ornamental sport design themes attached to the flush handle of a toilet. Des. Pat. No. 318,715, issued to Ronald P. Hardman on Jul. 30, 1991, illustrates an ornamental design for a toilet flush handle. The design is in the shape of a shoe and a football. Des. Pat. No. 318,716, issued to Ronald P. Hardman on Jul. 30, 1991, illustrates an ornamental design for a toilet flush handle. The design is in the shape of a baseball glove, a bat, and a baseball.

Des. Pat. No. 319,297, issued to Ronald P. Hardman on Aug. 20, 1991, illustrates an ornamental design for a toilet flush handle. The design is in the shape of a basketball net and a basketball. Des. Pat. No. 319,865, issued to Ronald P. Hardman on Aug. 20, 1991, illustrates an ornamental design for a toilet flush handle. The design is in the shape of a tennis racket and two tennis balls. Des. Pat. No. 320,646, issued to Ronald P. Hardman on Oct. 8, 1991, illustrates an ornamental design for a toilet flush handle. The design is in the shape of a golf putter and a golf ball on a tee.

The following design patents illustrate different types of toilet flush handles. Des. Pat. No. 301,919, issued to Stanley M. Paul on Jun. 27, 1989, illustrates an ornamental design of a lavatory handle. The design includes a three piece assembly of a base, a stand, and an elongated oblong shape handle. Des. Pat. No. 356,145, issued to John E. Bollenbacher on Mar. 7, 1995, illustrates an ornamental design of a trip handle for a water closet. The design includes two pieces that fit together with finger grooves located on its top surface.

Des. Pat. No. 367,519, issued to Alan D. Bengtson on Feb. 27, 1996, illustrates an ornamental design of a handle for a water closet. The design is of two pieces that fit together with finger grooves located on its top surface. Des. Pat. No. 356,630, issued to Ming-Jung Chuang on Mar. 21, 1995, illustrates an ornamental design of a handle of a flush toilet. The design includes a tear-shaped handle with a triangular flange. Des. Pat. No. 364,217, issued to Alfred R. Dubin on Nov. 14, 1995, illustrates an ornamental design for a lavatory faucet handle. The design is in the shape of an elongated cylinder.

Toilet flush handles accommodating apparatuses in the form of advertisements or apparatuses designed to receive an advertisement insert is a new target area for commercial businesses to promote their products and/or services.

None of the above inventions and patents, taken either singularly or in combination, is seen to describe the instant invention as claimed. Thus a novelty cover for toilet handle solving the aforementioned problems is desired.

SUMMARY OF THE INVENTION

The present invention is a novelty cover for the metal flush handles of commercial-grade urinals and toilets, primarily. There are two examples of the novelty covers and both are used for commercially advertising a business's product or promotional material. The first cover is a unitary piece having two hollow transparent tubes with one tube inside the other. Placed between the two hollow tubes is an advertisement insert that promotes a certain product, service, or event.

The second cover is also a unitary piece and is made of wood, plastic or acrylic similar to the first cover but the hollow outer tube is replaced with a plastic mold replica in the shape of the actual product being advertised. Both covers are held onto the metal flush handle by Allen screws and a Nylon, plastic, or rubber sleeve. After a person is through going to the bathroom, they grab hold of the novelty cover which is secured to the handle of the toilet and flush. As a result, businesses advertising their product or promotional material receive a lot of exposure.

Accordingly, it is a principal object of the invention to provide a novel apparatus used as a tool in advertising a product, service, or event.

It is another object of the invention to provide an apparatus that is easy to assemble and disassemble.

It is a further object of the invention to provide a three dimensional actual replica of the product being advertised.

Still another object of the invention is to provide every public restroom facilities with the novelty covers.

It is an object of the invention to provide improved elements and arrangements thereof of the novelty cover for the flush handle of toilets for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
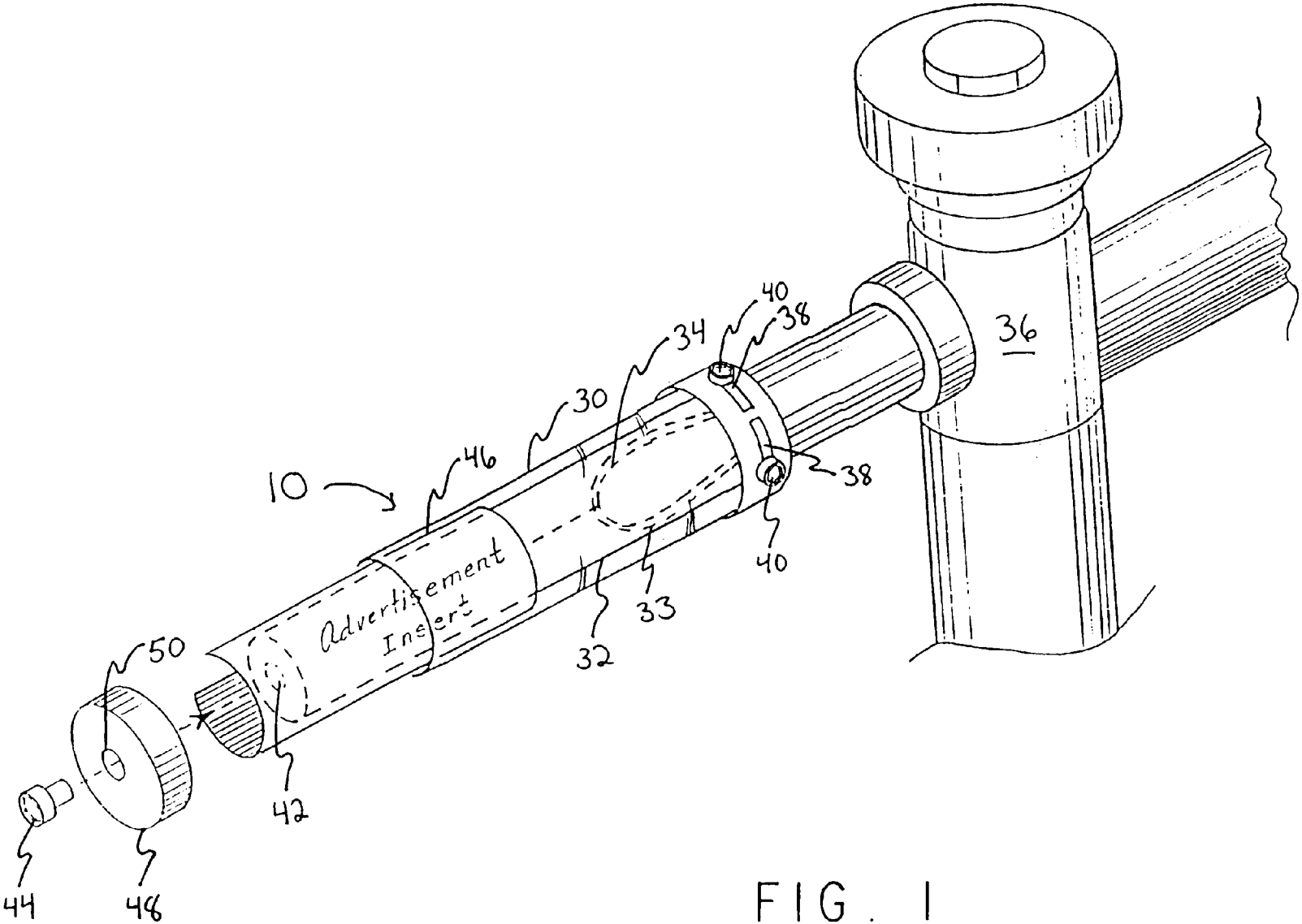
FIG. 1 is an exploded perspective view of the first example of the novelty toilet cover according to the present invention.

The present invention is an apparatus that covers the flush handle of commercially made toilets and urinals designated as 10 and 20 in the drawings. There are two examples of the present invention. The first example 10 is a container with a hollow outer tube and an inner tube. Printed matter which illustrates a particular advertisement is accommodated between the two tubes.

The second example 20 is a plastic, wood, or acrylic mold replica in the shape of a novelty piece or an actual product affixed onto wood or acrylic dimensioned and configured to slidingly fit onto a flush toilet handle. Instead of having a hollow outer tube to contain the advertisement, the outer tube is replaced with a plastic, acrylic, or wood mold replica in the shape of a novelty piece or the actual product being advertised or promoted. Both examples are attached in the same manner by having a Nylon, plastic, or rubber sleeve 33 tightly screwed onto the smallest diameter of a flush handle of a toilet by at least two Allen screws.

FIG. 1 illustrates the first example of the present invention 10. The first example 10 is a container comprising a hollow outer tube 30 and an inner tube 32. The inner tube 32 is dimensioned and configured to slide onto the flush handle 34 of commercially made toilets and urinals 36. The inner tube 32 is lined with a Nylon, plastic, or rubber sleeve 33 which is tightly screwed onto the smallest diameter of a flush handle of a toilet by at least two Allen screws. The inner tube 32 has an open end that slides onto the flush handle 34 of the toilet plumbing stem 36. On the sides of the tube 32 end there is at least two small apertures 38 dimensioned and configured to receive Allen screws 40. Two apertures 38 will suffice to secure the present invention 10 onto the flush handle 34 of the toilet plumbing stem 36.

The other end of the inner tube 32 is closed with a small aperture 42 dimensioned and configured also to receive an Allen screw 44. The hollow outer tube 30 is the same length as the inner tube 32 but is slightly larger in diameter. The end of the hollow outer tube 30 closest to the toilet 36 is dimensioned and configured to be attached to the end of the inner tube 32, thereby making the hollow outer tube 30 and inner tube 32 a unitary piece. On opposite sides of the hollow outer tube 30 end closet to the toilet, there is at least one small aperture (not shown) dimensioned and configured to receive an Allen screw 40. Two apertures will suffice to secure the present invention 10 onto the flush handle 34 of the toilet 56.

The hollow outer tube 30 is open at the end that receives the advertisement insert 46 and is sealed with a removable lid 48 by an Allen screw 44. The removable lid 48 comprises an aperture 50 in the center of its diameter dimensioned and configured to receive an Allen screw 44. When the advertisement insert 46 is placed between the hollow outer tube 30 and inner tube 32, the Allen screw 44 is passed through the lid's 48 aperture 50 and into the aperture 42 on the end of the inner tube 32 to secure the lid in place. The Allen screws 44 permits the lid 48 to be removed in order to replace the advertisement insert 46 and to prevent theft of the advertisement insert 46. The hollow outer tube 30 and inner tube 32 are either transparent and/or translucent and are made of a material which is light in weight.

Preferably, the small apertures 38 on the end of the hollow outer tube 30 and the apertures (not shown) on the end of the inner tube 32 are similarly placed to line up with each other. The present invention 10 slides onto the flush handle 34 of the toilet 36 and is fastened onto the smaller diameter of the flush handle 34 by two Allen screws 40 which pass through both the apertures 38 in the hollow outer tube 30 and inner tube 32. The Allen screws 40 are used to prevent theft.

Figure 2:
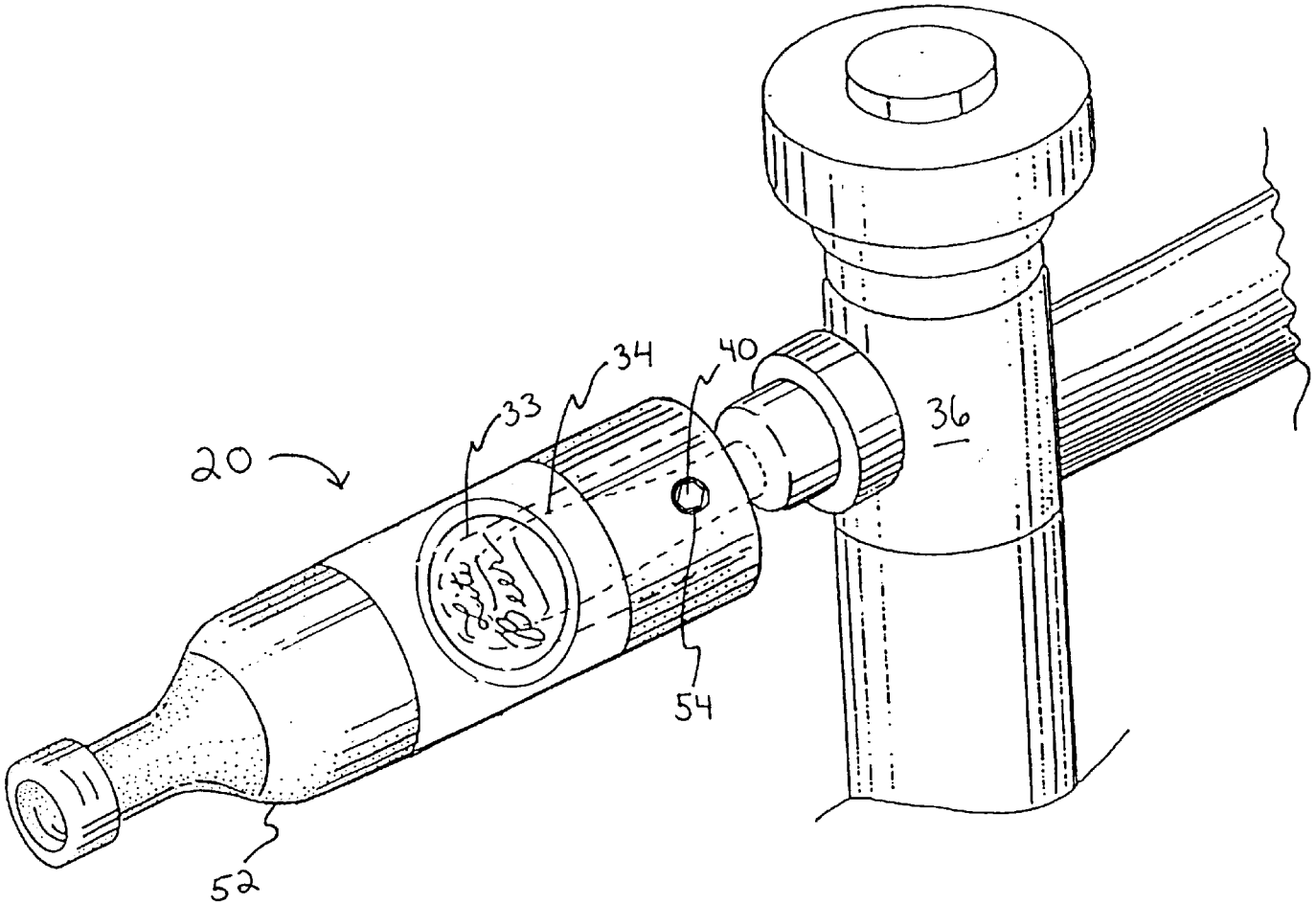
FIG. 2 is a perspective view of a second example of a novelty toilet cover of the present invention.

FIG. 2 illustrates the second embodiment of the present invention 20. The second embodiment 20 has two parts where a plastic or wood mold replica 52 in the shape of the actual product or novelty piece being advertised is one part and a nylon, plastic, or rubber sleeve 33 similar to the first example 10 makes up the other part. The Nylon, plastic, or rubber sleeve 33 is dimensioned and configured to slide onto the flush handle 34 of a commercial grade plumbing stem 36. The open end of the mold replica 52 slides onto the flush handle 34 and has at least two small aperture 54 dimensioned and configured to receive Allen screws 40. Two apertures will suffice to secure the present invention 20 onto the flush handle 34 of the toilet 36. The other end of the mold replica 52 is closed. The plastic, acrylic, or wood mold replica 52 in the shape of a novelty piece or the actual product being advertised comprises a hollow tubular space dimensioned and configured to receive mold replica 52. The plastic, acrylic, or wood mold replica 52 in the shape of a novelty piece or the actual product being advertised and the Nylon, plastic, or rubber sleeve 33 are made as a unitary piece, preferably. The plastic, acrylic, or wood mold replica 52 may be adhered or fused to the outer surface of the Nylon, acrylic, or rubber sleeve 33.

The plastic, acrylic, or wood mold replica 52 also has at least two small aperture (not shown) dimensioned and configured to receive Allen screws 40. Two apertures will suffice to secure the present invention 20 onto the flush handle 34 of the toilet 36. The aperture (not shown) on the end of the plastic, acrylic, or wood mold replica 52 and the aperture 54 on the inner tube 32 are similarly placed to line up with each other. The mold replica 33 part of the invention 20 slides onto the flush handle 34 of the toilet 56 and is fastened onto the smaller diameter of the flush handle 34 by at least two Allen screws 40. The Allen screws 40 and Nylon, plastic, or rubber sleeve 33 are used to prevent the present invention 20 from slipping off the metal flush handle 34 and to prevent theft of the present invention 20.

Preferably, the plastic, acrylic, or wood mold replica 52 is uniform in diameter although it may be textured, configured, and colored to match the product being advertised. The plastic, acrylic, or wood mold replica 52 is preferably configured to be three-dimensional to resemble the product being advertised. The Allen screws 40 enables the present invention 20 to be mounted on any toilet flush handle 34 regardless of the specific toilet handle configuration. This minimizes the number of different parts required for mounting onto toilet handles 34. The novelty toilet handle cover mounting apparatuses of the present invention 10 and 20 requires a minimum number of components which makes it easy to assemble and disassemble.

Advertisements placed in the stalls of bathrooms have been an area of interest to many businesses involved in advertising. Naturally, everyone flushes the toilet using the flush handle. As a result, the toilet flush handle makes an ideal environment for developing business advertising.

It is to be understood that the present invention is not limited to the embodiments described above, but encompasses any and all embodiments within the scope of the following claims.

I claim:

1. A removable apparatus used for advertising a product or any promotional material that covers the flush handle of a toilet comprising:

an inner tube and a hollow outer tube, said inner tube having one open end and one closed end, said inner tube with the open end adapted to slide onto a metal flush handle of a toilet, said hollow outer tube having one open end closest to the flush handle and having one end dimensioned and configured to receive an advertisement, said hollow outer tube being dimensioned and configured to receive said inner tube;

a removable lid dimensioned and configured to fit onto said open end of said outer tube closest to the flush handle;

a fastening means for attaching said removable lid to said closed end of said inner tube; and a fastening means for securely attaching said inner tube and hollow outer tube to the metal flush handle of a toilet.

2. A removable apparatus used for advertising a product that covers the flush handle of a toilet according to claim 1, wherein said inner tube is substantially transparent.

3. A removable apparatus used for advertising a product that covers the flush handle of a toilet according to claim 1, wherein said hollow outer tube is substantially transparent.

4. A removable apparatus used for advertising a product that covers the flush handle of a toilet according to claim 1, wherein said fastening means for attaching said removable lid to said closed end of said inner tube are Allen screws.

5. A removable apparatus used for advertising a product that covers the flush handle of a toilet according to claim 1, wherein said fastening means for attaching said removable lid to said closed end of said inner tube is a Nylon sleeve.

6. A removable apparatus used for advertising a product that covers the flush handle of a toilet according to claim 1, wherein said fastening means for securely attaching said inner and outer tube to the metal flush handle of a toilet are Allen screws which are tightened onto the smaller diameter of the flush handle.

* * * * *